United States Patent [19]

Johansen

[11] 4,164,847

[45] Aug. 21, 1979

[54] METHOD FOR COMBUSTION OF GASEOUS FUELS AND FLUE GASES

[76] Inventor: Svend B. Johansen, Calle Javier Vilanova 31, San Pedro de Premia, (Barcelona), Spain

[21] Appl. No.: 663,694

[22] Filed: Mar. 4, 1976

Related U.S. Application Data

[63] Continuation of Ser. No. 308,842, Nov. 22, 1972, abandoned.

[51] Int. Cl.[2] ..... F01N 3/10

[52] U.S. Cl. ..... 60/274; 60/298

[58] Field of Search ..... 60/286, 301, 303, 307, 60/274, 298; 23/277 C

[56] References Cited

U.S. PATENT DOCUMENTS

| | | | |
|---|---|---|---|
| 1,897,746 | 2/1933 | Winslow | 60/298 |
| 2,829,731 | 4/1958 | Clayton | 60/286 |
| 3,188,798 | 6/1965 | Jackson | 60/298 |
| 3,197,956 | 8/1965 | Clarke | 60/303 |
| 3,254,963 | 6/1966 | Leistritz | 60/303 |
| 3,287,900 | 11/1966 | Soltau | 60/307 |
| 3,435,613 | 4/1969 | Eannarino | 60/298 |
| 3,444,687 | 5/1969 | Andersson | 60/298 |
| 3,704,592 | 12/1972 | Panhard | 60/298 |

OTHER PUBLICATIONS

Chandler et al., "Nonflame Exhaust Gas Reactors", Vehicle Emissions, SAE, T.P.S.V.6 1964, pp. 300, 301.

*Primary Examiner*—Douglas Hart

*Attorney, Agent, or Firm*—Haseltine, Lake & Waters

[57] ABSTRACT

A method for combustion of gaseous fuels and flue gases in which the heat content of the combustion products is partially recycled to the combustion process by heat exchange with combustion air and/or gas, and air and gas are fed to a reaction chamber, where a surface combustion takes place separating air and gas regions, and the combustion heat by heat exchange is partially transmitted to air and gas prior to and during their entering the reaction zone giving off the heat to the combustion process, the surface combustion being maintained by the temperature of air and gas being above the ignition point of the mixture and above the ignition point of carbon monoxide/air mixtures.

6 Claims, 8 Drawing Figures

METHOD FOR COMBUSTION OF GASEOUS FUELS AND FLUE GASES

CROSS-RELATED APPLICATION

This application is a continuation of Ser. No. 308,842 filed Nov. 22, 1972 and now abandoned.

FIELD OF THE INVENTION

The present invention relates to a method and a reactor burner for combustion of gaseous fuels and flue gases by using excess combustion air and partial thermal reflux of the heat content of the combustion products and the combustion heat to the combustion process.

The use of gaseous fuels for heating purposes, e.g. in industrial kilns, involves a series of drawbacks, particularly when the service temperature is below the ignition point of the air/gas mixture.

The following should be stressed in particular: The great danger of explosion and resultant costly safety equipment, the possibility of great variations in temperature owing to the difference between the high temperature of the gas flame and the low temperature of the kiln system, the possibility of fuel waste in connection with the incidence of poisonous non-inflammable carbon monoxide/air mixtures if the flame is cooled by cold secondary air, together with low combustion rate, poor burner capacity and low convection rate of the combustion products when using conventional burner types.

PRIOR ART

The burner types used for said purposes are normally primary air/gas burners or mixed secondary and primary air/gas burners where the air/gas mixture is generated within or outside the burner. It is common to most of these burner types that by employing an almost theoretical air/gas mixture a high flame temperature is aimed at such that by heat exchange, mainly temperature radiation, the flame will heat the secondary air and/or the primary air/gas mixture fed to the flame until reaching its ignition point. Since air and gas are almost permeable to temperature radiation, they are slowly heated, and consequently the heating rate will determine the combustion rate and with that the burner capacity. Therefore, if the exhaust rate exceeds the heating rate and with that the combustion rate, the dreaded flame rise occurs and which may result in a violent explosion. When the combustion process has begun, its rate depends on the chain reaction velocity, which is enormous, until in the final stage of the combustion it is greatly reduced owing to the increasing difficulties in combining the fuel molecules and oxygen molecules in a theoretical air/gas mixture.

The combustion rate and the degree of reaction therefore also depend on the excess air, but if the latter is increased but little beyond the theoretical air to gas ratio, the flame temperature drops greatly to cause the heating rate to drop even more drastically owing to the extra air added and the enormous temperature dependency of the temperature radiation.

The said burner types are therefore confined to operate on an almost theoretical air/gas mixture if its maximum burner capacity is to be preserved.

Explosions in air/gas mixtures are possible in theory only when the kiln temperature is below the ignition point of air/gas mixtures, i.e., below about 500°-600° C. for most gaseous fuels. However, their combustion takes place via the intermediate stage, carbon monoxide, the ignition point of which in air is about 650° C., and therefore this temperature limit must be reckoned with for practical purposes, particularly if the kiln atmosphere is alternately reducing and oxidating.

Since the lower flammable limit for carbon monoxide in air is about 12.5% by volume at normal temperature, cooling by cold secondary air adjacent the flame may result in heavy fuel losses and extremely poisonous carbon monoxide/air mixtures.

Complete combustion of air/gas mixtures is possible only above the ignition point of carbon monoxide/air mixtures which are flammable in any ratio above said point.

Satisfactory equalization of temperature in kiln systems having a service temperature below the ignition point of the air/gas mixture is attainable at high convection rates of cooled combustion products. The aforesaid drawbacks attaching to the use of gaseous fuels for the purpose of obtaining low temperature may therefore be attributed to the fact that the combustion takes place in air/gas mixtures in conjunction with adverse temperatures and rates of air, gas and combustion products.

SUMMARY OF THE INVENTION

The method for combustion of gaseous fuels and flue gases, including exhaust from internal combustion engines, will overcome said drawbacks by using excess combustion air and partial thermal reflux of the heat content of the combustion products and the combustion heat to the combustion processes, the method according to the invention being distinguished in that the heat content of the combustion products being partially fed back to the combustion process by heat exchange with combustion air and/or gas, which may additionally be in mutual heat exchange, whereupon air and gas are fed to a reaction chamber such that immediately after the introduction into the reaction chamber, a surface combustion takes place in a reaction zone which separates air and gas regions, whereby by heat exchange the combustion heat is partially transmitted to air and gas immediately prior to and during their entering the reaction zone where they partially give off the heat received.

In order to maintain the surface combustion it is required that air and gas when meeting in the reaction zone be on or above the ignition point of the air/gas mixture, and the complete conversion of the combustion is subject to the surface combustion being further maintained above the ignition point of carbon monoxide/air mixtures.

A reactor burner to achieve the method according to the invention may therefore be formed from one or more heat exchangers and a reaction chamber, into which are inserted gas pipes connected to one of the heat exchangers, and air pipes enclosing, e.g. the gas pipes and thereafter connected to the second heat exchanger. Said two heat exchangers may have respective common heat exchange surfaces, and at least one of the heat exchangers is in communication with the hot combustion products from the reaction chamber.

Air and gas are fed to their respective heat exchanger, and in the reaction chamber the combustion is initiated by ignition.

At the beginning of the combustion air is mixed with gas by convection and diffusion within the reaction chamber. Since this mixture is incomplete and the combustion air moreover cold, the combustion becomes poor and incomplete, bearing no comparison with the combustion obtained in conventional gas burners.

However, the air and gas are preheated by the hot combustion products via heat exchangers to rising temperatures so as to cause the thickness of the layer of air/gas mixture behind the flame to constantly decrease, while retaining combustion in air/gas mixtures, until the mixture reaches its ignition point.

When air and gas upon being joined reach the ignition point, the course of the combustion is totally changed as the flame flashes back, not only onto the orifice of the gas pipe, but also onto the surface of the gas jet to thereby separate gas regions from air regions by a common reaction zone for the combustion such that this becomes a surface combustion.

The transformation of the combustion could also be described to the effect that the gas now flows through a heat exchanger, the wall of which is formed by the reaction zone of the combustion, and the latter is at the same time a heat-exchanging surface for the combustion air.

The air and gas reacting in the reaction zone are therefore in continuous, separate heat exchange with the combustion process, whereby air and gas are strongly preheated, whereby the temperature of the reaction zone is increased, whereby the preheating is increased, etc. This means that the reaction zone is subject to a chain reaction-resembling temperature rise until very high temperatures and resultant high heat exchange capacity are obtained. The volume of gas enclosed in the reaction zone will there fore be subject to thermal decomposition which could produce a sooty flame unless there is a great surplus of air. When the excess air is increased, the temperature of the surrounding medium will drop, however, without the temperature of the reaction zone being affected as much as in a conventional gas burner because the air blanket against the reaction zone is actually in continuous heat exchange with the latter, and because the combustion does not take place in an air/gas mixture which cannot in fact be preheated beyond the ignition point.

It is therefore possible in the reactor burner outlined to obtain high air, gas and flame temperatures, while effecting the combustion with excess air. The burner has therefore partly been freed from its dependence on a theoretically composed air/gas mixture.

As the combustion process has been freed from its two slow rate determining factors, the heating process of air and gas as well as the lack of oxygen in the final stage of the combustion, it will be seen that the rate of combustion becomes fantastic, probably 100 to 1000 times the normal rate of combustion based on cold air/-gas mixtures, and therefore also the burner capacity is rendered enormously high which further means that the combustion will be possible at high nozzle rates with a small burner volume.

For use in connection with low-temperature kiln systems the reactor burner will be made from metallic components, and therefore the reaction zone having the high temperature should not be in positive contact with the walls of the reaction chamber, and this may be avoided by adding to the burner so much excess air that the reaction zone is surrounded by a medium of lower temperature protecting the metallic components.

The heat exchange of the combustion products with air and gas will reduce their exhaust temperature so as to be close to the service temperature of the kiln system. This fact and the high burner capacity result in a high convection rate of the combustion products which makes it possible to obtain a highly satisfactory equalization of temperature in the kiln system.

Since the combustion is maintained above the ignition point of the carbon monoxide, the danger of explosion and the incidence of poisonous carbon monoxide mixtures should have been eliminated.

The useful capacity of the reaction burner is determined by the attainable velocities of feeding air and gas and the heat exchange capacity of the burner.

As the combustion within the reactor burner is surface combustion, this part of the heat exchange will be proportional to the combustion surfaces, and separation of air and/or gas into sectional jets of any shape will therefore mean increased heat exchange between the combustion process and air and gas.

The thermal reflux of the combustion heat may be further enhanced by feeding air and gas through long ducts which are heated by temperature radiation from the combustion process, after which the ducts will transmit heat to air and gas, mainly by conduction and convection.

BRIEF DESCRIPTION OF THE DRAWINGS

The invention will now be further explained in the following with reference to the drawings in which.

DETAILED DESCRIPTION

Figure 1:
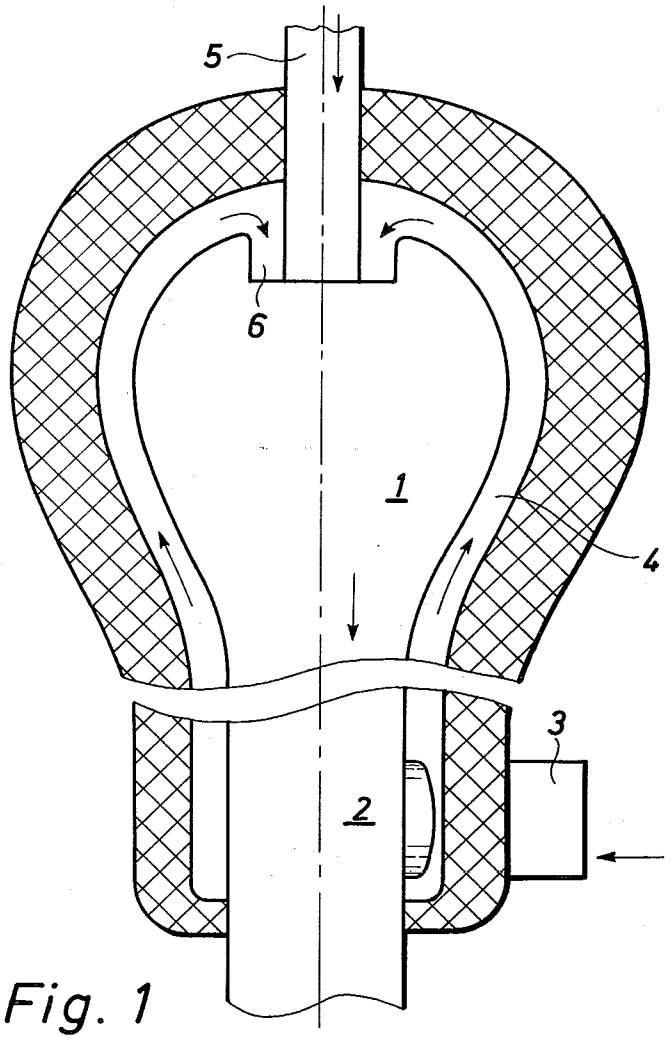

FIG. 1 shows an embodiment of the reactor burner, comprising a reaction chamber 1 extended by an exhaust chamber 2. The combustion air is fed through a line 3 to an inflow chamber 4 which encloses the reaction chamber and the exhaust chamber, to thereby cool these, and the combustion air is preheated in counterflow and fed into the reaction chamber 1 through an opening 6 while flowing in the same direction as the gas which is introduced through a short inflow passage 5, for which reason the gas is only sparingly preheated before entering the reaction chamber. As in this case the combustion air is required to have a high temperature, the thermal strain on the burner is great.

Figure 2:
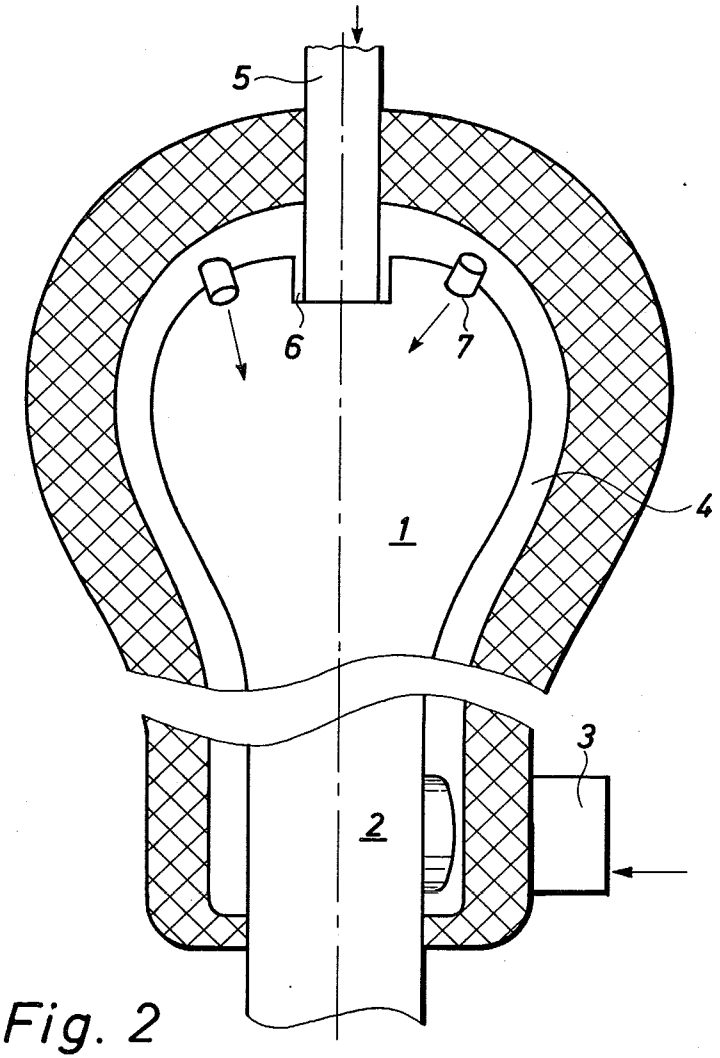
FIGS. 1 and 2 are a cross-sectional view of particularly simple embodiments of the burner having rectilinear inflow of one of the components, usually gas, into the reaction chamber.

FIG. 2 shows a similar embodiment, but in this case the opening 6 is closed or constricted such that the combustion air is fed exclusively or partially through tangential nozzles 7 in a turbulent flow somewhat spaced from the gas conduit, to thereby obtain a high flame temperature and controlling at the same time the temperature of the surrounding medium by means of the excess air. Furthermore, the turbulent flow prevents localized heating of the wall of the reaction chamber.

Figure 3:
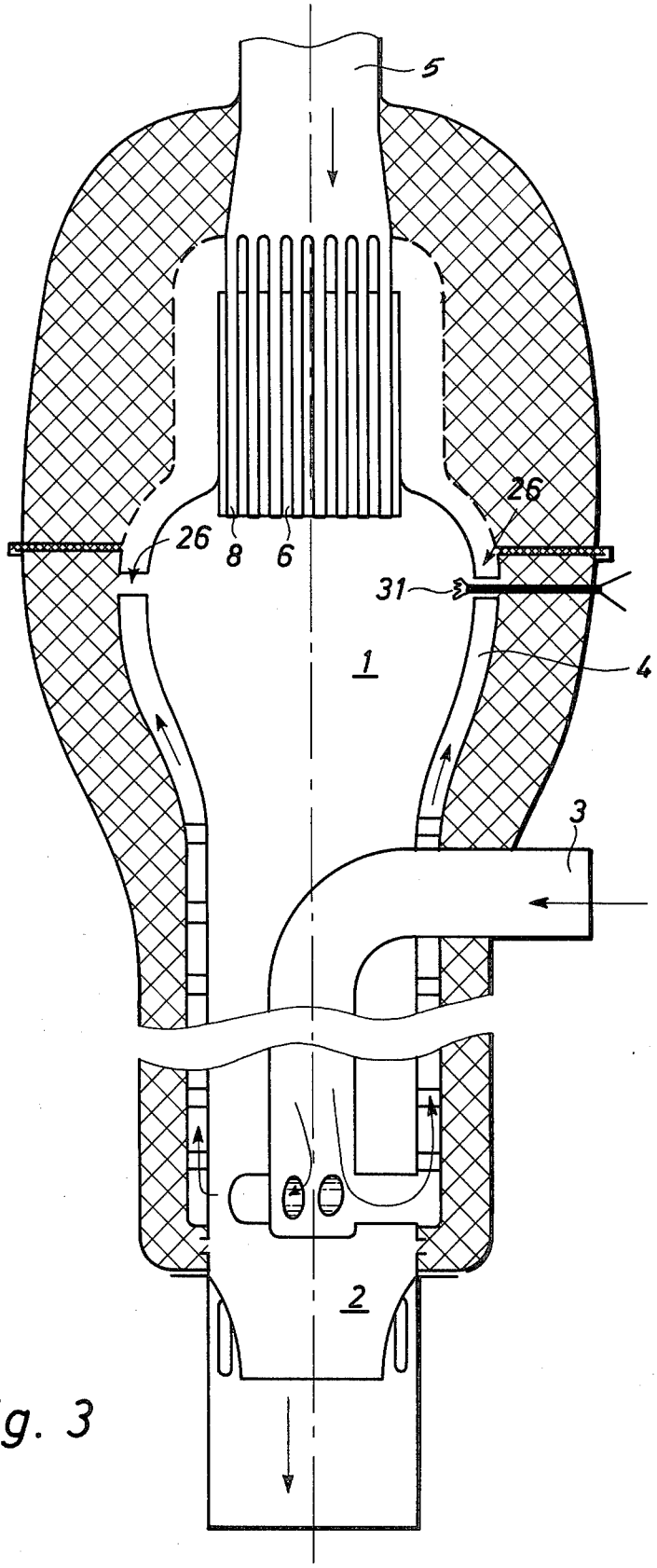
FIG. 3 is likewise a rather simple embodiment of the burner, to be used preferably as secondary combustor and silencer in connection with an internal combustion engine.

FIG. 3 shows an embodiment where the gas is fed to the reaction chamber 1 in sectional flows through long ducts 8 and cocurrently with the preheated combustion air. Thereby, it is achieved that air and gas will enter the reaction chamber 1 having generally the same temperature, while maintaining a satisfactory reflux of combustion heat and a low thermal strain on the burner components. The air fed through the line 3 is first preheated in concurrent flow with the hot combustion products and thereafter in counterflow passing around the exhaust chamber and reaction chamber.

Figure 4:
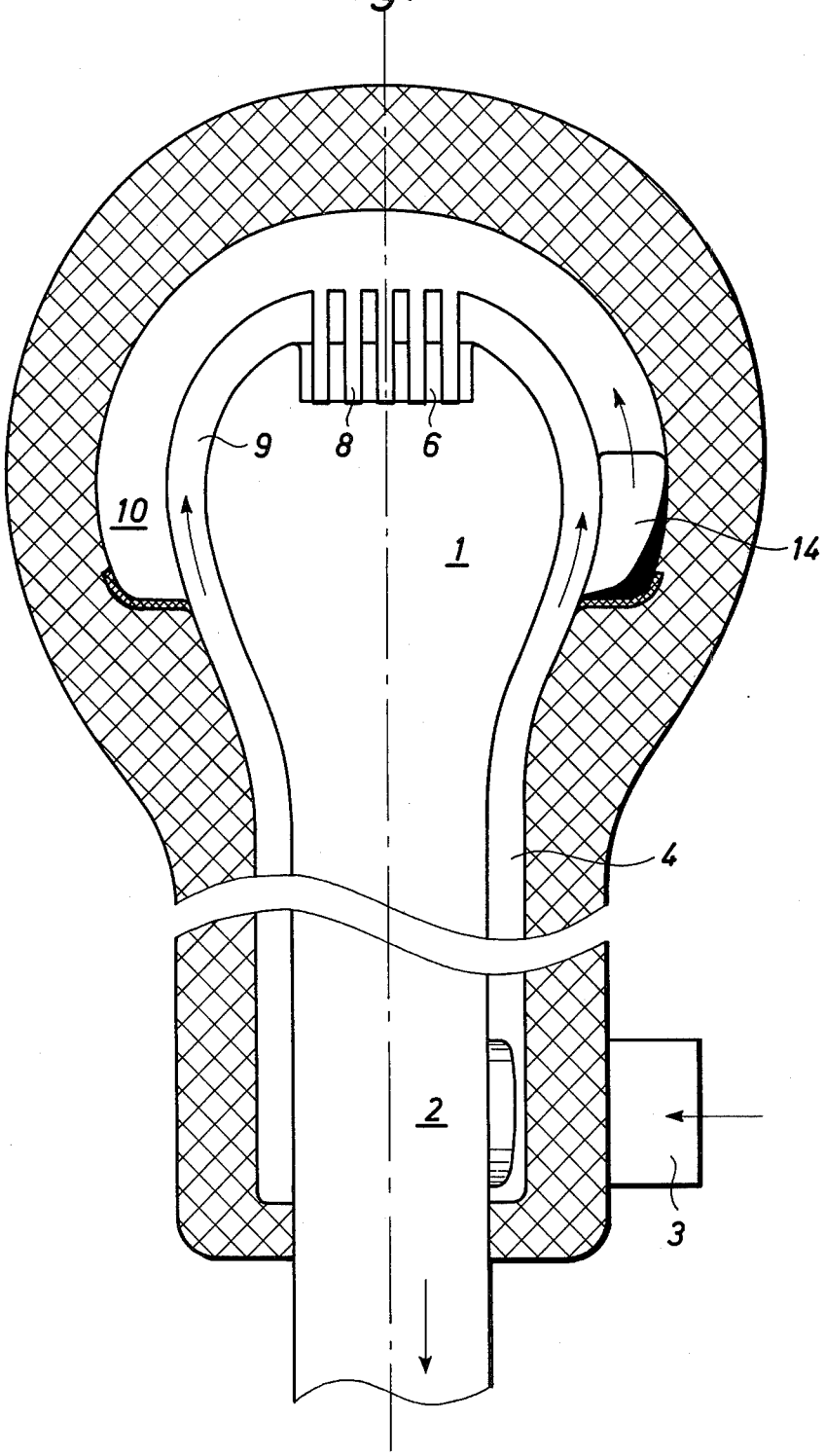
FIGS. 4 and 5 show reactor burners with preheating of both gas and air in the presence of turbulent flow conditions.

FIG. 4 shows an embodiment where air and gas are fed to respective inflow chambers 9 and 10 arranged in rotary symmetry in turbulent direct and indirect heat exchange with the reaction and exhaust chamber of the hot combustion products.

In possible combination with the principle shown in FIG. 2 it is thereby achieved that owing to the turbulent motion the reactor burner is capable of operating in all positions and inclinations, without locally superheating its metallic components. It is further achieved that the eddies will carry the more preheated air or gas to the inflow ducts for introduction into the reaction chamber. It will be appreciated that although it is presupposed in the foregoing that the air is introduced at 3 and the gas at 5 or a tangential opening 14 (FIGS. 4, 5, 7 and 8), the reversed procedure could also be imagined.

In the said embodiments, which merely represent some of the possible ones, the exhaust temperature of the combustion products is adjusted to the service temperature by regulating gas and air volumes but may also be effected by the addition of extra air after the burner through slots by ejector effect.

The application of the method according to the invention is not, however, restricted solely to heating purposes below the ignition point of air/gas mixtures in that the air and gas heat exchanger formed by the combustion process represents the ideal high-temperature heat exchanger, the preheating to high temperatures taking place immediately prior to the reaction of the preheated products in the reaction zone.

As, moreover, an appropriate amount of excess air will suppress the dissociation of carbon dioxide and water vapour, a suitable adjustment of the excess air could be expected to result in higher flame temperatures in the reactor burner than in conventional gas burners operating on air/gas mixtures. In combination with substantial thermal reflux in heat exchange with the hot combustion products this means that it should be possible to make effective economical kilns and chemical reactors adapted for temperatures above the ignition point of air/gas mixtures on the basis of the said method and principles. In kilns and reactors for high temperatures it will be necessary to employ ceramic refractory materials, particularly for reaction chambers and the termination of gas nozzles.

As ceramic materials are usually poor heat conductors, it normally will not be expedient to encircle the reaction chamber, identical to the kiln chamber, with combustion air and/or gas.

Figure 6:
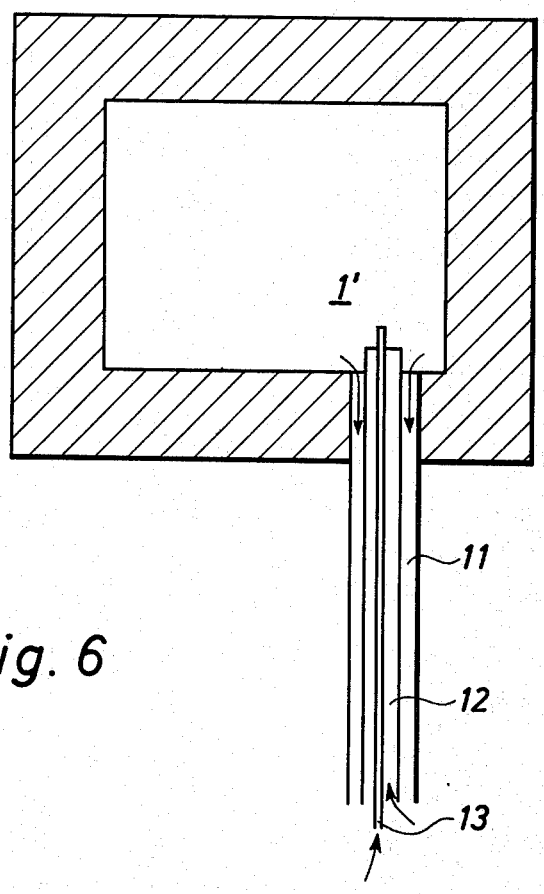
FIG. 6 is a sectional view of a reactor burner according to the invention formed as a kiln and chemical reactor.

With reference to these objects, FIG. 6 shows a possible embodiment of a kiln or reactor for high temperatures, retaining the continuous thermal reflux of the heat content of the combustion products and the combustion heat to the combustion process by removing the flue gases from the reaction chamber 1' in counterflow with the combustion air and/or gas introduced, and therefore part of the heat exchange is effected through the surfaces of smoke, air and gas ducts 11, 12 and 13 respectively, and these should consequently be of suitable length and surface area to obtain the desired thermal degree of reflux, the value of which determines the excellent economy in heating.

The method according to the invention should likewise be suitable for combustion of fuel residue in flue gases seeing that above all the removal of this residue is a question of maintaining the combustion above the ignition point of carbon monoxide/air mixtures. Owing to the extremely poor thermal value of flue gases, it normally will not be possible to maintain the combustion based on combustion in air/gas mixtures, whereas this should be possible in the reactor burner with its continuous and separate preheating of air and gas, provided the total thermal reflux is rendered sufficiently substantial.

Of the universal air pollution by flue gases 90% of carbon monoxide is derived from the exhaust of internal combustion engines, and therefore the application of the reactor burner for the purpose of reducing or removing the exhaust nuisances is of the utmost interest. This interest is further enhanced as the reactor burner also makes it possible to reduce noise nuisances from internal combustion engines without reducing the engine power, on the contrary it may be increased under certain circumstances.

In order to achieve the said effects, the exhaust is subjected according to the invention to a pretreatment in an inflow chamber 10 arranged in rotary symmetry, as shown in FIG. 4 said chamber being connected through heat-insulating pipes or a heat-insulated exhaust manifold to the exhaust passages of the engine.

The exhaust is fed tangentially to the inflow chamber 10 through an opening 14 in the periphery of the chamber and removed after preheating by heat exchange with the combustion air in the chamber 9 adjacent the center of the inflow chamber and fed into the reaction chamber 1 in the same direction as with the combustion air, after which the combustion takes place at the end of the gas ducts 8.

In this method some of the kinetic energy of the exhaust is stored as rotary energy, particularly about the intermediate position of the exhaust stroke, whereas rotary energy is transmitted to the exhaust in the extreme positions of the exhaust stroke where the piston velocity is zero. The exhaust eddy in the inflow chamber therefore has an effect analogous to the flywheel of the engine, except that the exhaust flywheel is mass-replacing as mass elements of large kinetic volume are applied to the periphery of the flywheel and corresponding mass elements of small kinetic volume are removed adjacent the eddy center.

The mass-replacing exhaust flywheel may be used for drawing exhaust from the engine cylinder and for gas-dynamic scavenging of compression chambers. This makes it possible to increase the compression substantially without changing the ratio of compression which is tantamount to increasing the engine power and improving at the same time the fuel economy. The displacement of exhaust with air/fuel mixture may be improved by the compression chamber being of U-shape. It should be added that the maximum power of the exhaust flywheel may be safely utilized only in connection with burning off the exhaust as otherwise the flammable and poisonous contents of the exhaust may have increased. In order to achieve maximum power and economy it is likewise necessary that the predischarge period and the period of overlapping of the inlet and outlet valves be adapted to the effect of the exhaust flywheel.

A similar increase in power improving the economy is attainable if the combustion air is fed on an average constant relatively to the exhaust and at a positive pressure, to thereby enable the combustion air to evacuate the exhaust by injector effect.

The exhaust eddy in the inflow chamber will further cause an equalization of differences in concentrations of fuels during an exhaust stroke for the benefit of uniform combustion of the exhaust.

Figure 5:
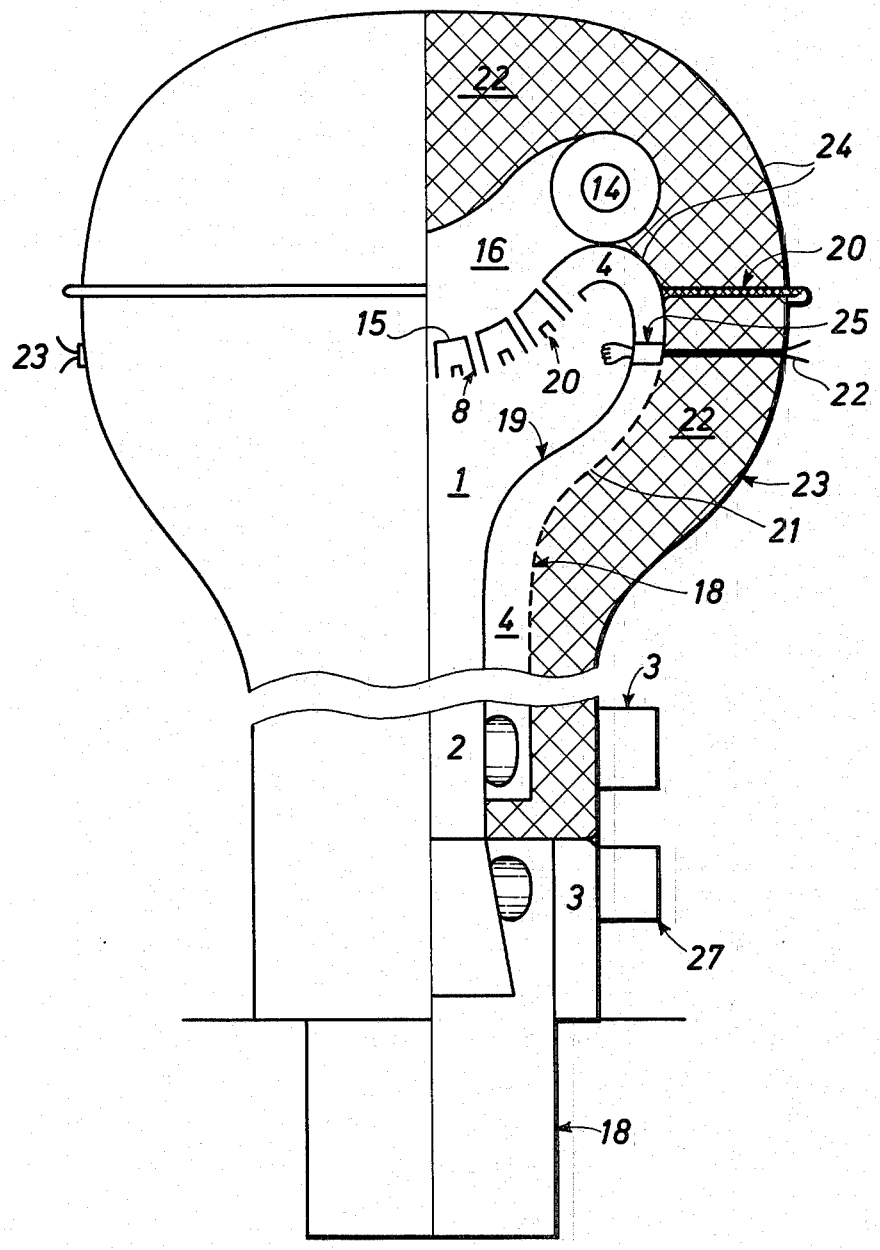
Figure 7:
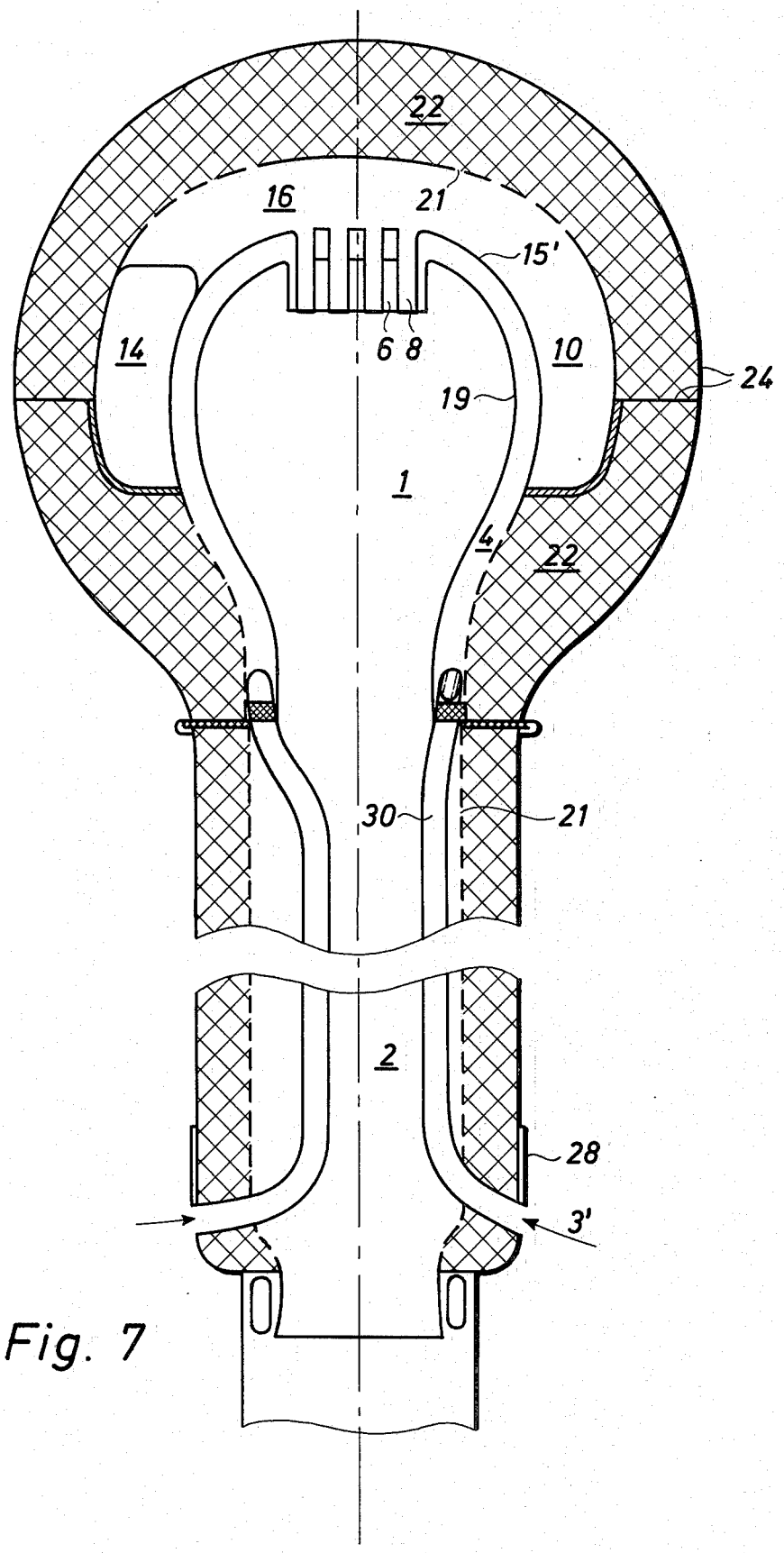
FIGS. 7 and 8 are variants of the embodiments of FIGS. 4 and 5 for secondary combustion of flue gases.
Figure 8:
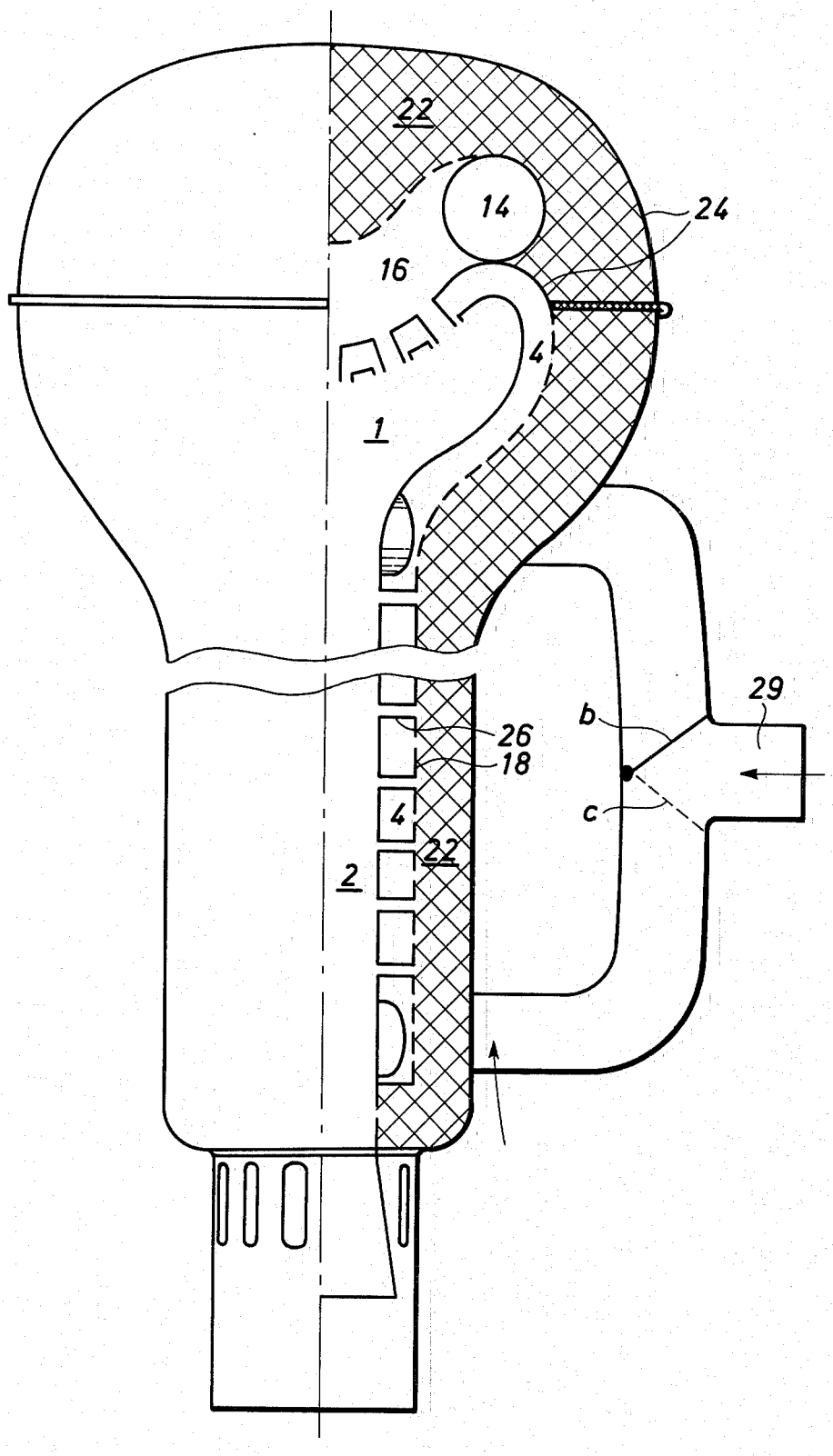

The mass-replacing exhaust flywheel also seeks to maintain a constant mass passage of the exhaust gas through the inflow chamber arranged in rotary symmetry, whereby pulsation and sound waves in the exhaust are likewise damped. This damping effect may be enhanced as shown in FIGS. 5, 7 and 8 by surrounding the inflow chamber by an outer pressure-proof housing 24 and filling the space with a heat-insulating as well as sound-absorbing material 22 and perforating the wall of the inflow chamber facing said material, as shown at 21.

The suppression and absorption of sound in the inflow chamber is further improved by presence of a hot air column in the center of the exhaust eddy and which in connection with the velocity field of the eddy creates an acoustic deflection field which partly prevents the sound waves, particularly high-frequency waves, from reaching the reaction chamber of the reactor burner. The sound waves within the reaction chamber are reflected and deflected in the enhomogeneous temperature field deriving from the combustion, to thereby achieve also in the reaction chamber suppression and absorption of sound. Additional damping of sound and pulsation may be achieved by inlet pipes or exhaust manifold, air preheaters and discharge chamber 2 being surrounded by outer pressure-proof housings 23 and filling the space with a heat-insulating as well as sound-absorbing material 22 and by the wall of the discharge chamber being coupled to the sound-absorbing space by means of slots, pipes 26 and/or perforations 21.

As the exhaust gas after the pretreatment in the inflow chamber is conducted into the reaction chamber in pulsation and sound damped state, the counter pressure necessary for further silencers will be extremely small, and it should therefore be possible to use the kinetic energy of the exhaust for evacuating by ejector effect the necessary combustion air, whereby it should be possible, particularly in minor internal combustion engines, to save an otherwise indispensable air blower.

According to the invention the combustion of the exhaust gas is effected in two stages, the first one of which is a thermal decomposition and/or a reductive combustion of nitrogen monoxide to nitrogen, in the latter case by using the reductive components of the exhaust and in both cases subject to heating the exhaust gas to exceed the ignition point of nitrogen monoxide and reductive components by means of the combustion heat from the subsequent oxidative combustion in the reaction chamber with excess air from the other flammable components of the exhaust, particularly carbon monoxide, hydrocarbon and hydrogen.

As the volume and temperature of the exhaust are subject to extremely great variations during different speeds and loads on the internal combustion engine, and since the amount of fuel may momentarily switch from high to low values, e.g. when passing from high power to braking, it would be impossible to effect combustion of the exhaust based on theoretically composed air/exhaust mixtures.

The method according to the invention is characterized by employing a generally constant ratio between combustion air and exhaust with an amount of excess air at least capable of effecting a complete combustion of the largest volume of fuel present, and rating the heat exchange capacity such that the combustion may be maintained above the ignition point of the carbon monoxide/air mixture under otherwise varying conditions in the exhaust.

As great variations in the volume of fuel may cause substantial temperature variations in the reactor burner, the temperature of the reaction chamber may be adjusted via the thermal reflux by combustion air and/or gas being fed to the heat exchangers, utilizing fully or partially their total capacity.

As far as the combustion air is concerned, this has, for instance, been illustrated in FIG. 8 where blast air from a pipe 29 and normally by means of a throttle in position b is conducted through the entire heat exchanger for air, whereas at increased temperatures the air may be passed through a shorter length of the heat exchanger when the throttle is in position c for cooling the reaction chamber. The throttle position may be controlled through a thermal relay.

FIG. 5 illustrates a variant of the burner of FIG. 4 where the inflow chambers, arranged in rotary symmetry, for gas and air 16 respectively 4 have a different configuration, and where each sectional gas jet is surrounded by a sectional air jet. There is further shown a pipe stub 27 through which additional air is fed in turbulent motion to the hot combustion products flowing from a discharge chamber 2. This makes it possible to adjust the temperature of the exhaust from the reactor burner so as to have the desired value. In this manner the temperature for heating, e.g., a kiln chamber which is heated by the reaction burner, is easy to adjust. The embodiments of FIGS. 7 and 8 are specifically intended for application in conjunction with combustion of the exhaust from internal combustion engine. In both embodiments the gas is fed through a tangential inlet pipe stub 14 to the inflow chamber 16 arranged in rotary symmetry, and the air is fed through inlet openings to the identically formed inflow chamber 4 for air. In FIG. 7 the air is fed through openings 3' to a heat exchanger consisting of a plurality of thin pipes 30 carried up through the discharge chamber 2 for combustion products from the reaction chamber and terminate tangentially in the inflow chamber 4 enclosing the reaction chamber. The air fed through the openings 3' is adjusted by means of a slidable gate 28. The exhaust gas of the engine flowing from the chamber 16 through pipes 8 is drawn by injector effect of the preheated air through the pipes 30 of the air heat exchanger, the air inflow chamber 4 and the opening 6 into the reaction chamber.

It will be seen that in both FIGS. 7 and 8 the air is first preheated in counterflow with the combustion products discharged from the reaction chamber and where the preheating of the combustion air is terminated by turbulent agitation of the reaction chamber in combination with the turbulent combustion air transmitting heat to the likewise turbulent gas in the inflow chamber 16. Owing to the turbulent motion the more preheated air and gas are impelled towards the eddy center where the inlet passages for air and gas to the reaction chamber are located.

The heat exchanger for the combustion air of the embodiment shown in FIG. 8 is constituted by the discharge chamber 2 which is surrounded by the air inflow chamber 4 arranged in rotary symmetry. In case the combustion air, as presupposed in FIG. 8, is fed from a blower, the air blower should be coupled to the main shaft of the engine or to a secondary shaft rotating proportionally therewith over the entire speed range of the engine if approximately the same ratio between exhaust and air is to be maintained for all speeds of the engine. The air blower should further have a suitable adjustable air intake aso as to make it possible to adjust the volume of air fed to the reactor burner in conformity with the setting of the engine and the reactor burner. The reaction chamber may be fixed with respect to the outer wall of the inflow chamber 4 for combustion air by means of the pipes 26. It is possible through said pipes or pipe bushing to insert temperature detectors or ignition devices 31, e.g. as shown in FIG. 3. The ignition may be connected to the electrical system of the engine across its choke means, and said choke means may be arranged at any upstart of the engine to cause the feeding of a rich fuel/air mixture and through that a flammable exhaust to the reactor burner and choke means, and the ignition may be adapted to switch off simultaneously.

It will be appreciated that the reactor burner according to the invention may also be used as a chemical reactor for the conversion of chemically reactive gases in lieu of operating on gas and combustion air.

What I claim is:

1. A method for the combustion of the exhaust gases from an internal combustion engine with air comprising feeding exhaust gas from an internal combustion engine and air along separate paths in heat exchange relation with one another towards a reaction chamber where combustion takes place and where heated products of combustion are conveyed for discharge, injecting said exhaust gas and said air into said reaction chamber to form a thin boundary layer therebetween, heating the exhaust gas and air in said separate paths by the heated products of combustion by heat exchange therewith such that the exhaust gas and air are each raised to a temperature of at least the ignition point of the gas-air mixture to cause a flameless surface combustion to take place in said thin boundary layer transmitting from said boundary layer additional combustion heat by respective heat exchange with the incoming gas and air immediately prior to and during their entry into the reaction chamber to insure that the gas and air are at least at the temperature of the ignition point, effecting a thermal reducing reaction of the exhaust gas in an inflow chamber in a first stage before combination of the exhaust gas with the air in the reaction chamber, and introducing said exhaust gas from the engine into said inflow chamber to produce rotation of the exhaust gas in said inflow chamber which draws the exhaust gas from the cylinders of the engine to effect dynamic scavenging thereof and serves as a flywheel with respect to evacuation of the exhaust gas from the engine, a predischarge period and period of overlapping of the inlet and outlet valves of the engine being adapted to the flywheel effect of the rotating exhaust gas.

2. A method according to claim 1 wherein the inflow chamber is formed coaxially with the reaction chamber, said exhaust gases being fed tangentially into the inflow chamber at the periphery thereof and discharged at the center thereof into the reaction chamber.

3. A method according to claim 1 comprising feeding the secondary air under pressure into the reaction chamber to develop an injector effect on the exhaust gases.

4. A method according to claim 2 comprising surrounding the inflow chamber with heat and sound absorbing material.

5. A method according to claim 2 comprising feeding the air to the reaction chamber in a separate inflow chamber symmetrically arranged with respect to the inflow chamber for the exhaust gases and in heat exchange contact therewith.

6. A method according to claim 1, wherein during heat exchange with the hot combustion products air is passed around said reaction chamber, and is fed into said chamber concurrently with the exhaust gas in simultaneous mutual heat exchange therewith such that the surface combustion is generated at a location in which it has no appreciable contact with the wall of the reaction chamber, said wall being internally contacted by hot completely reacted combustion products.

* * * * *